US006028295A

United States Patent [19]

Rong

[11] Patent Number: 6,028,295

[45] Date of Patent: Feb. 22, 2000

[54] MOUNTING OF FILAMENT HEATER AND ELECTRIC CONDUCTION PLATE

[76] Inventor: Chern-Bao Rong, No. 410, Lien Cun Road, Feng Yuan City, Taichung Hsien, Taiwan

[21] Appl. No.: 09/210,654

[22] Filed: Dec. 14, 1998

[51] Int. Cl.[7] ..... H05B 3/00

[52] U.S. Cl. ..... 219/537; 219/505; 219/541; 338/326; 338/22 R

[58] Field of Search ..... 219/505, 536, 219/537, 541, 542, 550, 544; 338/322, 326, 332, 22 R

[56] References Cited

U.S. PATENT DOCUMENTS

| | | | |
|---|---|---|---|
| 4,180,723 | 12/1979 | Szupillo | 219/541 |
| 4,899,032 | 2/1990 | Schwarzl et al. | 219/541 |
| 5,125,070 | 6/1992 | Chung-Tai | 392/485 |

*Primary Examiner*—John A. Jeffery
*Attorney, Agent, or Firm*—Harrison & Egbert

[57] ABSTRACT

An improved mounting apparatus for the attachment of a filament heater between electric conduction plates of a space heater device comprises a first electric conduction plate, a second electric conduction plate, a plurality of filament heaters positioned between the electric conduction plates, a plurality of electric conduction rings positioned on opposite sides of each of the filament heaters, and a seat having a receiving trough for receiving the electric conduction plates and the filament heaters therein. Each of the electric conduction plates includes a suitable mounting hole therein. An elastic pressing piece extends around the mounting holes so as to exert a compressing force upon the respective electric conduction rings on the filament heaters. The seat includes suitable pillars that can receive screws so as to secure the electric conduction plates and the filament heaters within the seat.

2 Claims, 6 Drawing Sheets

MOUNTING OF FILAMENT HEATER AND ELECTRIC CONDUCTION PLATE

FIELD OF THE INVENTION

The present invention relates generally to a filament heater and an electric conduction plate, and more particularly to an improved mounting of the filament heater and electric conduction plate.

BACKGROUND OF THE INVENTION

As shown in FIGS. 1 and 2, the conventional filament heater and electric conduction plate is constructed of a seat 12 which is provided with a plurality of holes 13 on the surface and attached to an inner electric conduction plate 14. The surface of the inner electric conduction plate 14 has a plurality of circular holes 15 that correspond to the plurality of holes 13 of the seat 12 and that also hold the filament heater 16. The surface of filament heater 16 is attached to an outer electric conduction plate 17 which also contains mounting holes 18 to match each location of filament heaters 16. The edge of mounting hole 18 is formed with ring trough 19, so as to enable the outer electric conduction plate 17 to use ring trough 19 of mounting hole 18 to connect to the edge surface of filament heater 16 secured by a plurality of screws 20 fastening both outer electric conduction plate 17 and seat 12. Furthermore, the inner electric conduction plate 14 together with the outer electric conduction plate 17 clip the filament heater 16 in place. However, such construction as described above is defective in design for the following reasons:

1. The process in manufacturing the filament heater 16 must be very accurate. If it happens to be rough and uneven in its surface, then the filament heater 16 cannot be tightly mounted between the inner electric conduction plate 14 and outer electric conduction plate 17. Therefore, it is easy to create poor electric conduction or cause a spark in electric current because of the space therebetween. As a result, producing a filament heater 16 with the necessary precise flatness is very difficult and is not cost effective to manufacture.
2. The inner electric conduction plate 14 and outer electric conduction plate 17 must also be very accurate for tightly mounting the filament heater 16. This is especially true for the outer electric conduction plate 17 which is the main member in mounting the filament heater 16. Therefore, the outer electric conduction plate 17 is formed with ring trough 19 for attaching to the edge surface of filament heater 16. If the process in manufacturing the outer electric conduction plate 17 happens to deform the ring trough 19 or if the ring trough 19 is not planar for any reason, then the outer electric conduction plate 17 cannot be tightly mounted to the filament heater 16. It causes the construction of the conventional filament heater and electric conduction plate to poorly conduct electricity in the filament heater 16. In addition, since the surface of filament heater 16 cannot contact closely with the inner electric conduction plate 14 and outer electric conduction plate 17, it is therefore likely to produce a spark from the electric current in the space therebetween and to potentially create a dangerous fire situation.

SUMMARY OF THE INVENTION

The primary objective of the present invention is to provide an improved mounting for a filament heater and electric conduction plate that allows the filament heater and electric conduction plate to connect closely with each other.

The present invention can prevent the bad electric conduction or a spark in electric current.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
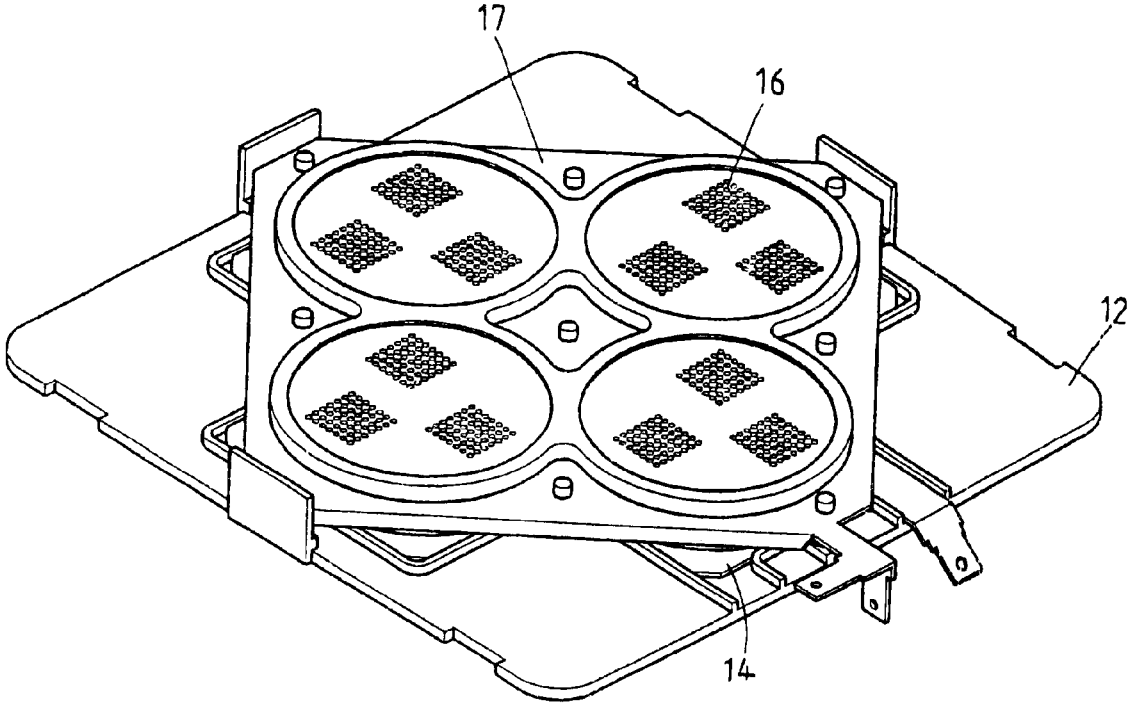
FIG. 1 shows a perspective view of the prior art filament heater and electric conduction plate in combination.
Figure 2:
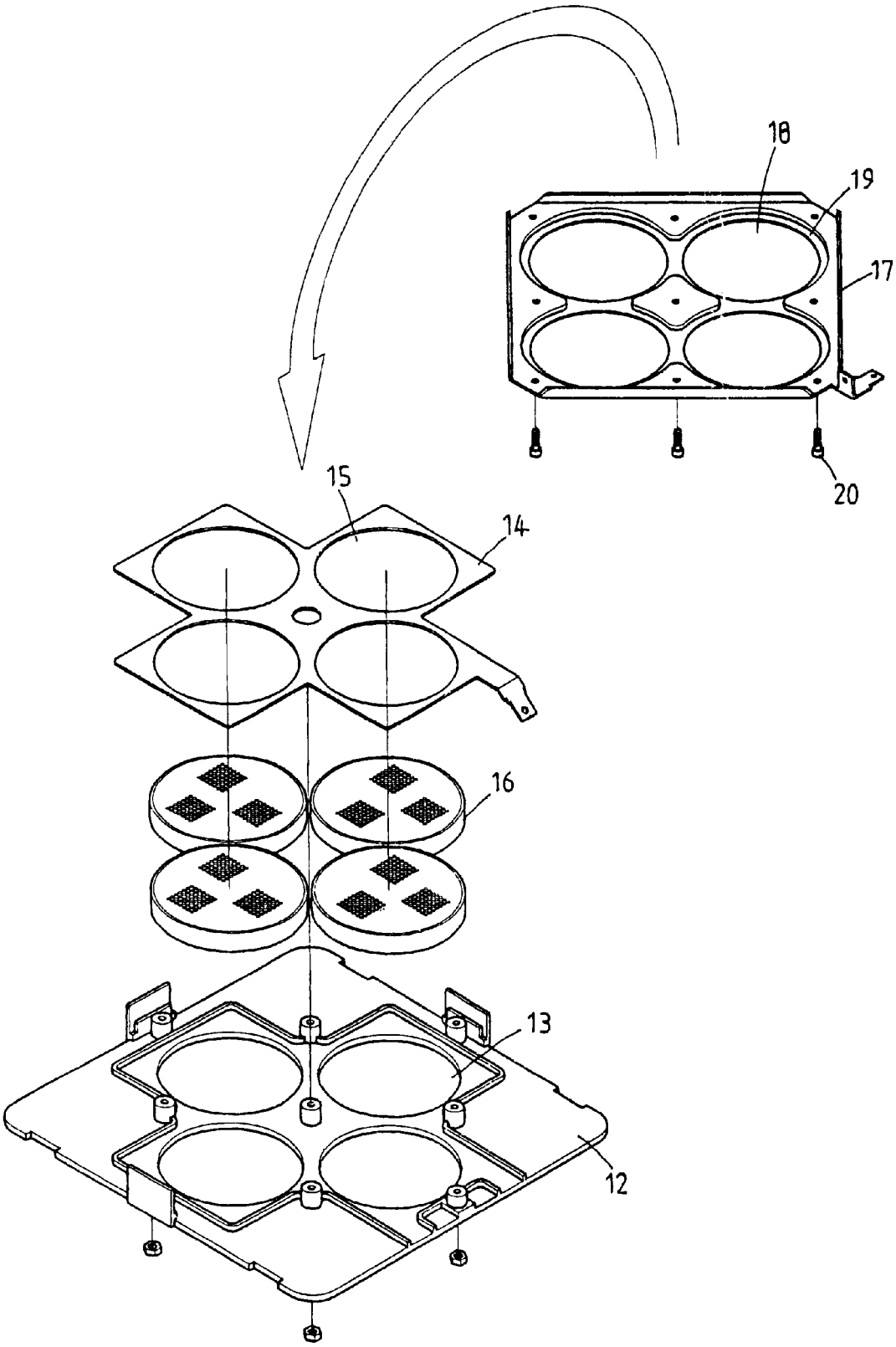
FIG. 2 shows an exploded view of the prior art filament heater and electric conduction plate.
Figure 3:
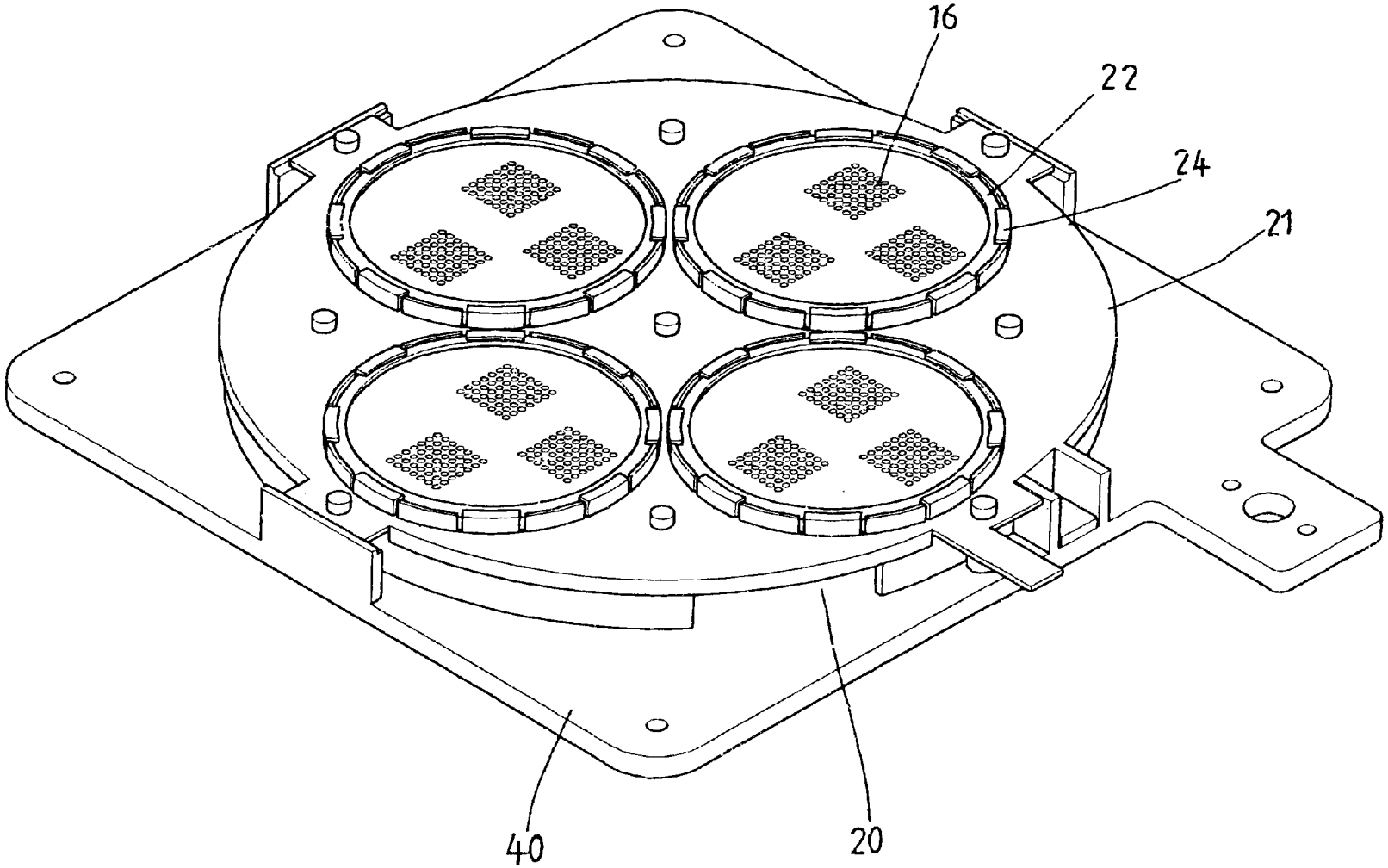
FIG. 3 shows a perspective view of the present invention in combination.
Figure 4:
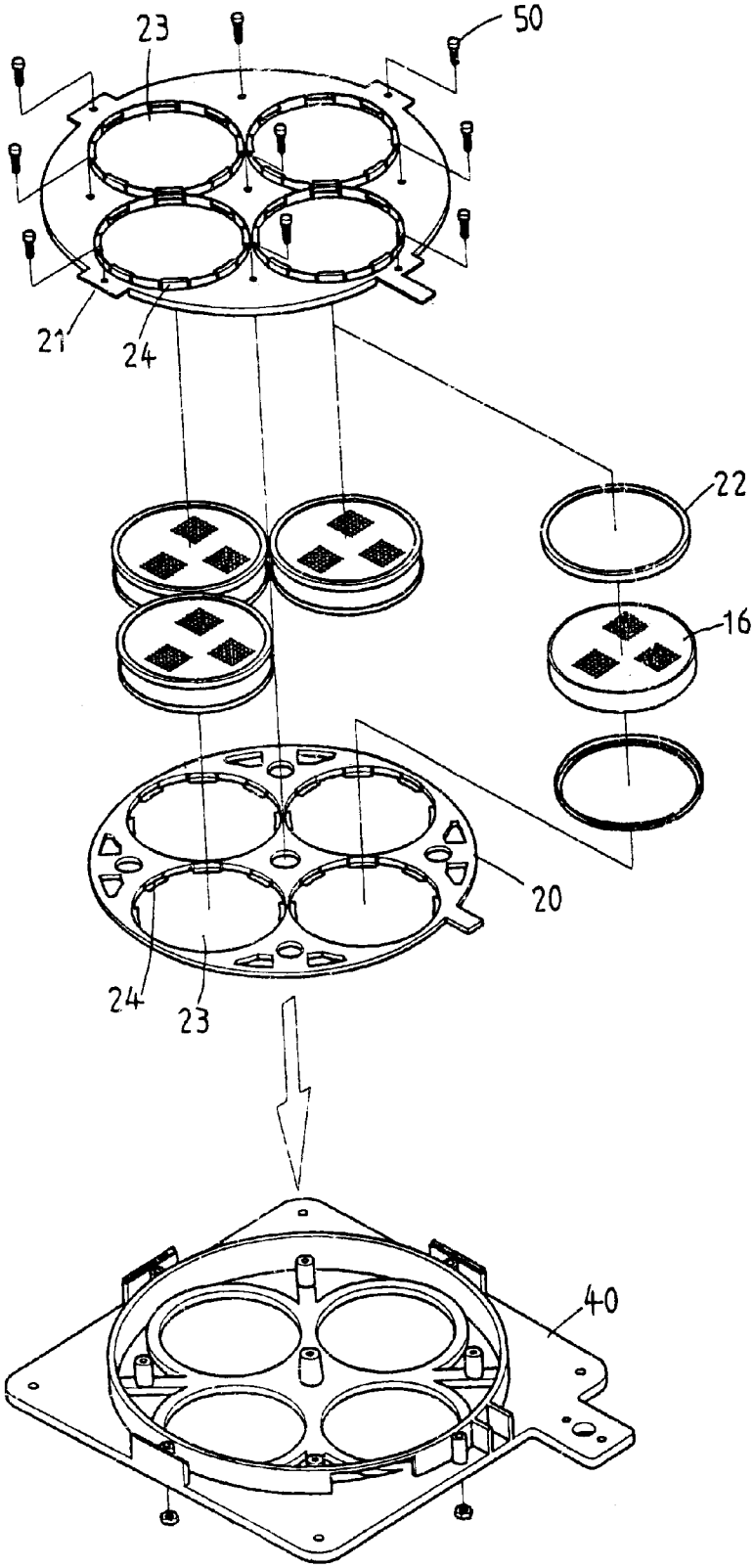
FIG. 4 shows an exploded view of the present invention.
Figure 5:
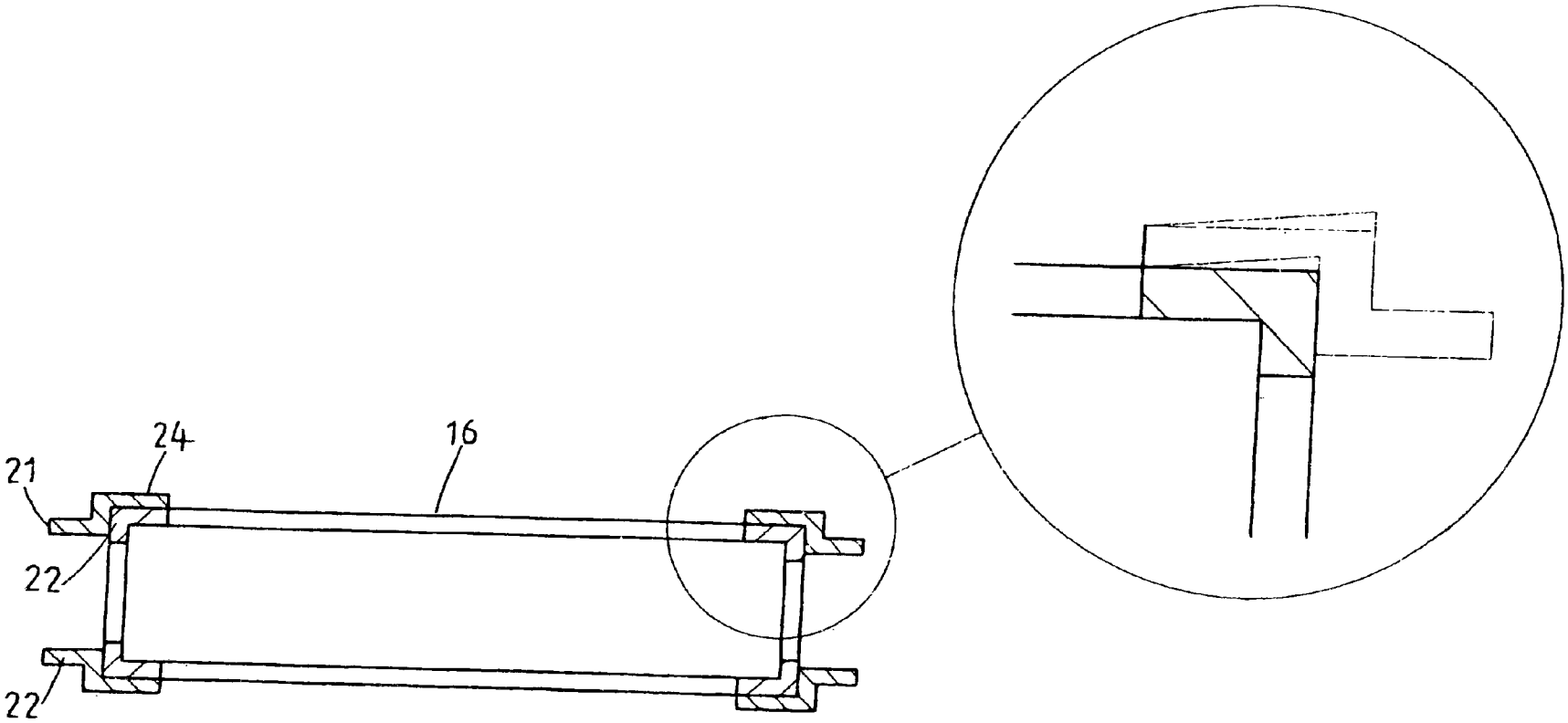
FIG. 5 shows a schematic view of an electric conduction plate of the present invention.

As shown in FIGS. 3, 4, and 5, an improved mounting of filament heater and electric conduction plate are constructed of two electric conduction plates 20, 21, a plurality of filament heaters 16, a plurality of electric conduction rings 22, and a seat 40.

Two electric conduction plates 20. 21 have a corresponding plurality of holes 23 on their surfaces. The plurality of mounting holes 23 have protruded a plurality of elasticity press pieces 24 around the edge of the holes 23 on the outside surfaces.

A plurality of filament heaters 16 are located between two electric conduction plates 20, 21 and are clipped into place: by elasticity press piece 24 of mounting hole 23.

A plurality of electric conduction rings 22 are placed around both sides of the surface edge of filament heater 16, so as to enable two electric conduction plates 20, 21 to take the advantage of elasticity press piece 24 of each mounting hole 23 to closely contact the electric conduction ring 22 of filament heater 16.

The seat 40 has formed receiving trough 41 on she surface. In order to correspond to the plurality of mounting holes 23 of two electric conduction plates 20, 21, the receiving trough 41 contains a plurality of holes 42 at the bottom end thereof and further, a plurality of convex pillars 43. The plurality of mounting holes 23 of two electric conduction plates 20, 21 each clip the filament heater 16, then when placed into the receiving trough 41 of seat 40, the plurality of screws 50 can pass through the two electric conduction plates 20, 21 and tightly fasten the plates 20,21 to the plurality of convex pillars 43 of seat 40.

Figure 6:
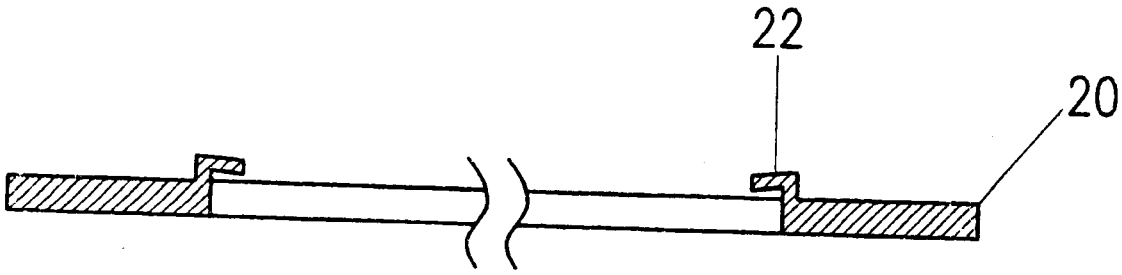
FIG. 6 shows part sectional view of filament heater and electric conduction plate of the present invention in combination.

As shown in FIGS. 5 and 6, the present invention of improving the mounting of the filament heater and electric conduction plate includes elasticity press pieces 24 which extend with a suitable slanting angle to contact the surface of filament heater 16.

In the present invention, as shown in FIGS. 4, 5, and 6, if the process in manufacturing the filament heater 16 is rough and uneven on its surface, the electric conduction ring 22 can be put around the surface of the filament heater 16 to improve contact with the two electric conduction plates 20,

21. Even though the edges of filament heater 16 are not in direct contact with the two electric conduction plates 20, 21, the elasticity press piece 24 around each edge of mounting holes 23 in the electric conduction plates 20, 21 should directly contact the electric conduction ring 22. Because the elasticity press piece 24 has a proper extended slanting angle (as shown in FIG. 5), the elasticity press piece 24 will be bent into place by the force exerted when the two electric conduction plates 20, 21 are clipped to filament heater 16 by screws 40. Because of the angle and flexibility, the elasticity press piece 24 presses back against the electric conduction ring 22. Therefore, besides being cost effective and easily manufactured, the present invention securely mounts the electric conduction plate 20, 21 and filament heater 16, and further prevents poor electrical conductivity and potential sparking from the electric current.

The embodiment of the present invention described above is to be deemed in all respects as being merely illustrative and not restrictive. Accordingly, the present invention may be embodied in other specific forms without deviating from the spirit thereof The present invention is therefore to be limited only by the scopes of the following appended claim.

I claim:

1. An apparatus comprising:

a first electric conduction plate having a plurality of mounting holes formed in a surface thereof, each of said plurality of mounting holes having an elastic pressing piece protruding inwardly into and extending therearound;

a second electric conduction plate in spaced relation to said first electric conduction plate, said second electric conduction plate having a plurality of mounting holes formed in a surface thereof, each of said plurality of mounting holes of said second electric conduction plate having an elastic pressing piece protruding inwardly into and extending therearound;

a plurality of filament heaters positioned between said first and second electric conduction plates, each of said plurality of filament heaters being clipped by a respective pressing piece into position within respective mounting holes of said first and second electric conduction plates;

a plurality of electric conduction rings positioned on opposite sides of each of said plurality of filament heaters, said pressing pieces of said first and second electric conduction plates directly contacting respective electric conduction rings;

a seat having a receiving trough formed on a surface thereof, said receiving trough having a plurality of pillars extending upwardly therefrom, said surface of said seat having a plurality of through holes formed therein, said plurality of through holes positioned so as to correspond respectively with said plurality of mounting holes of said first and second electric conduction plates, said receiving trough receiving said first and second electric conduction plates and said plurality of filament heaters therein; and a plurality of screws extending through said first and second electric conduction plates, said plurality cf screws being fixedly fastened respectively into said plurality of pillars.

2. The apparatus of claim 1, each of said pressing pieces having a surface slanting at an angle toward an adjacent side of a respective filament heater.

* * * * *